US005335615A

United States Patent [19]

Björkman

[11] Patent Number: 5,335,615

[45] Date of Patent: Aug. 9, 1994

[54] TANKER VESSEL

[76] Inventor: Bengt A. S. Björkman, 6, rue Victor-Hugo, F-06240 Beausoleil, France

[21] Appl. No.: 64,077

[22] Filed: May 20, 1993

[30] Foreign Application Priority Data

Nov. 23, 1990 [SE] Sweden ..... 9003736-7

[51] Int. Cl.[5] ..... B63B 25/08

[52] U.S. Cl. ..... 114/74 R; 114/125

[58] Field of Search ..... 114/74 A, 74 R, 121, 114/125, 76, 77, 78, 256, 257, 65 R, 74 T; 220/901

[56] References Cited

U.S. PATENT DOCUMENTS

| | | | |
|---|---|---|---|
| 3,797,440 | 3/1974 | Pangalila | 114/125 |
| 3,943,873 | 3/1976 | Hering et al. | 114/74 R |
| 4,241,683 | 12/1980 | Conway | 114/74 R |
| 4,715,309 | 12/1987 | Liberg | 114/74 R |
| 4,759,307 | 7/1988 | Scott | 114/125 |
| 5,086,722 | 2/1992 | Sloope et al. | 114/74 R |

FOREIGN PATENT DOCUMENTS

| | | |
|---|---|---|
| 83588 | 4/1954 | Norway . |
| 146943 | 9/1982 | Norway . |
| 350229 | 10/1972 | Sweden . |
| 1302476 | 1/1973 | United Kingdom . |

*Primary Examiner*—Stephen P. Avila
*Attorney, Agent, or Firm*—Fisher, Christen & Sabol

[57] ABSTRACT

The present invention relates to a tanker vessel for the transportation of oil or other liquids, which present a danger to the environment: the tanker vessel consists of a hull with a bottom (10), two sides (12, 14), an upper deck (16), at least two longitudinal bulkheads (18) and a number of transverse bulkheads, which together form a number of center tanks (28) and side tanks (24, 26), wherein a mainly horizontal between deck (22), located considerably below the load water line of the ship, divides at least the side tanks into upper and lower compartments (24, 26). In order to eliminate or reduce the risk of oil spills caused by collision damages in the side, according to the present invention, the upper side tanks (26) are ballast tanks, while the lower side tanks (24) are cargo oil tanks, which at the head are connected to vertical oil riser trunks (30), which via branch (36) with a non-return valve, are connected to an oil reception tank.

13 Claims, 1 Drawing Sheet

TANKER VESSEL

Figure 1:
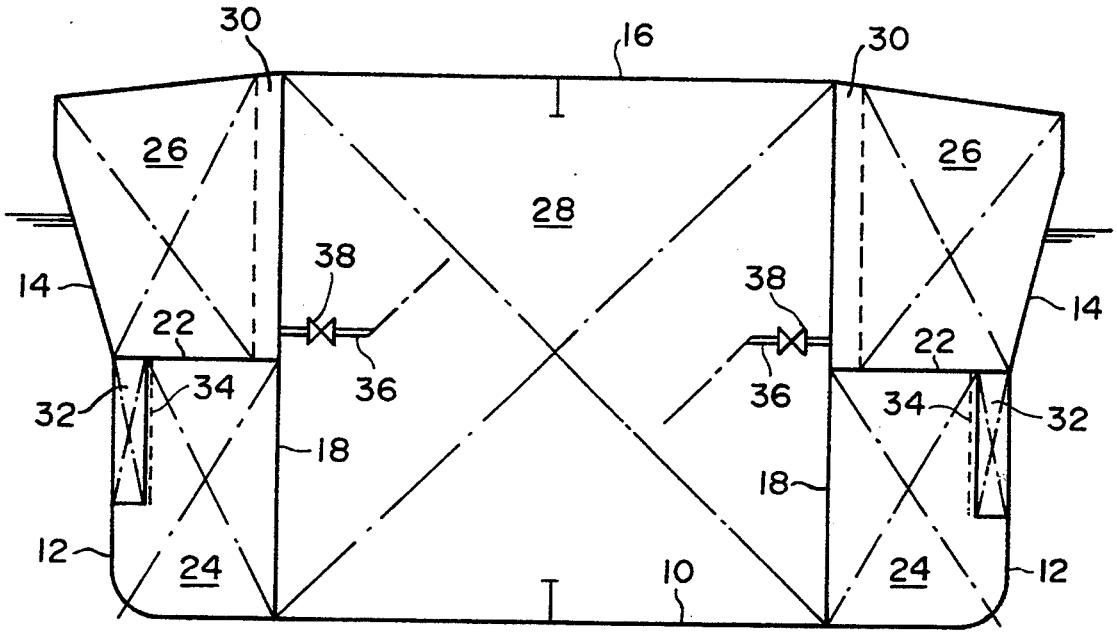

The present invention relates to a tanker vessel for the transportation of oil and other liquids, which are lighter than water and present a danger to the environment, and which is arranged to prevent spills in the event of a hole in the side thereof.

The invention relates particularly to a tanker vessel according to the introduction of patent claim no. 1.

Since oil and other liquids leaking out of a tanker vessel in collision frequently cause damage to the marine environment, the rather bad protection in this respect of tanker vessels has become a current problem. Certain authorities have issued requirements that a tanker vessel must be arranged with a double side shell to reduce the risk of oil spills in collisions.

Certainly such a solution leads to an improved protection against leakages and spills in less heavy collisions, but it has a number of important disadvantages. The vessel's cargo capacity is reduced as the volume between the double side walls can only be used for ballast. The double side shell construction also becomes heavier and more complicated and therefore more expensive. The surface area to protect against corrosion also increases considerably.

It must also be noted that double side walls cannot guarantee that oil does not spill and pollute the environment in the event of a heavy collision.

A study has shown that a tanker vessel of breadth 57.5 metres and double side walls spaced 3.9 and 6.0 metres apart respectively has a probability of 80% and 60% respectively to spill oil in collision, i.e. the probability is relatively high that the inner wall is damaged in collision, when it is located 6.8% and 10.4% respectively of the breadth of the ship inside the outer side wall.

International rules for tanker vessels transporting dangerous chemicals demand a distance between the double side walls of at least 20% of the ship's breadth to achieve a reasonable safety level even if this means that about 40% of the ship's tank volume cannot be used for cargo.

A tanker vessel is nowadays divided into a relatively low number of center and side tanks by at least two generally vertical longitudinal bulkheads and by a number of transverse bulkheads.

Such a tanker vessel, built according to international rules for the prevention of pollution at sea, has, in the form of ballast tanks, a limited, built-in protection against oil spills in collisions and groundings.

An improved design of tanker vessel with a means to prevent fluid leakage in the event of a hole in the bottom thereof is described in GB patent 1 302 476, where the cargo tanks are equipped with at least one horizontal deck positioned so that when the tanker is afloat and loaded, the static pressure of the fluid in the lower tanks is lower than the static pressure of the sea water on the outside of the tanker. In grounding, the oil does not leak through the hole caused. None or very few tankers with a built-in horizontal deck, dividing the cargo tanks in upper and lower tanks to prevent spills in grounding, have ever been built due to technical and operational difficulties. Satisfactory solutions about e.g. access to the lower tanks or how to arrange the cargo piping system have not been found.

A considerable disadvantage of this type of tanker is that protection against oil spills in collision is missing.

For example, a hole in the side can damage several upper and lower tanks so that sea water flows in and presses out all oil, which does not flow out by itself due to higher static pressure.

In accordance with the present invention comes a proposal for a new solution to the problem of how to prevent, or to a high degree, reduce the risk of oil spills from tankers of the type as outlined in the introduction of patent claim no. 1, if such a tanker should collide with another ship or object, or if a hole in the side of the hull is caused for another reason.

The damage in the side is assumed to be caused when the kinetic energy of the tanker vessel and/or the other ship or object—the collision energy—is absorbed by the side shell plating, frames and transverse webs of the tanker vessel, which then are ripped apart.

The oil spill is assumed to occur when the oil in an upper side tank due to higher static pressure flows out through the hole in the side.

The oil spill is also assumed to occur when the potential energy of the inflowing water is absorbed by the oil in the lower side tank, the possibility of which is only to leak out through the hole in the side.

According to the idea of the present invention, there is a tanker according to the type described in the introduction of patent claim no. 1, where the upper side tanks are water ballast tanks, while the lower side tanks are cargo oil tanks, each of which at the head is connected to vertical, oil riser trunks, which, in turn, have a pipe branch fitted with a non-return valve, which is connected to an oil reception tank.

Furthermore, the lower side tanks are equipped with a cofferdam, which, in turn, is fitted with a liner of reinforced, elastic plastic material.

Thanks to this solution, the risk of oil spills in collision is eliminated or reduced as follows:

A) The collision energy is mainly absorbed by side shell platings, frames and transverse webs in the outboard sloping side wall of the upper side tank, which first will be in contact with the other ship or object, which can be ripped apart. Sea water is allowed to flow into the upper side tank which is a ballast tank and no oil will then flow out. It is also not probable that the vertical longitudinal bulkhead, which normally is located more than 20% of the breadth from the outer side wall, is damaged.

B) The collision energy is also absorbed by the plating and the cofferdam of the side wall of the lower side tank, when they are in contact with the other ship or object, and they are also allowed to rip open. The water is therefore allowed also to flow into the lower side tank, which is a cargo oil tank.

C) The liner of reinforced, elastic plastic material is expected either to prevent the sea water to flow in or to reduce the inflow of sea water.

D) If sea water flows into the lower side tank, which is a cargo oil tank, the water sinks to the bottom of the side tank and presses the oil or fluid liquid up against the horizontal deck and up into the oil riser trunk. The oil can then escape through the pipe connection with non-return valve to a reception tank, i.e. the pressure and kinetic energy of the inflowing water is absorbed by the oil partly as pressure energy in the oil itself, partly as kinetic energy in the oil which escapes through the pipe connection.

The oil escapes from the damaged lower side tank in a way which offers least resistance, i.e. through air in the pipe connection in the oil riser trunk to a reception tank. Very little oil is expected to leak through the hole in the damaged side because then the oil must flow against the inflowing sea water.

E) The above arrangement to prevent oil spill in collision does not require any active action by the crew when the collision occurs.

F) The above arrangement to prevent oil spill in collision is an economic use of the tanker's cargo volume where only the upper side tank are reserved for ballast.

G) Above arrangement to prevent oil spill in collision works as long as the energy of the inflowing sea water can be absorbed as pressure energy in the cargo oil or liquid and as kinetic energy in the oil, which escapes to the reception tank. This energy can be calculated by e.g. Bernoulis theory. If the hole in the side is very large, then the energy flow is very large and then it can happen that it cannot be absorbed as pressure energy and kinetic energy in the oil without an oil spill. But the invention takes this into account. It is necessary to limit the size of the hole in the lower side tank. In a 90° collision, the side wall platings, frames and webs are pushed inboard and ripped open, but then the reinforced, elastic plastic liner is expected to be effective and to reduce the net surface of the hole caused by the damage. A collision at e.g. 45° angle is worse, because then the side wall plating and liner can be sheared off and leave a large opening, but then the outboard sloping side of the upper side tank is expected to be effective, i.e. it will shear off first absorbing most of the collision energy.

H) The reception tank can be a particular cargo oil tank or an upper side tank reserved for ballast and the pipe system can be so arranged that the reception tank is not expected to be damaged, when the relevant lower side tanks are damaged.

I) The arrangement uses the physical phenomena that oil is lighter than water and does not mix with it. When the water flows into the lower side tank, the oil forms a (big) "bubble," which floats in the water and which is kept in place by undamaged pans of the tank and the inflowing water.

Viscous forces in the oil and forces in the boundary layer between the oil and water also keep the bubble together, while it is emptied to the reception tank. There is no big static pressure difference in the boundary layer between the oil and water in way of the horizontal deck. There is, however, a pressure differential in the boundary layer between the oil and water in the lower part of the bubble, but the bubble can absorb this pressure as pressure energy without damaging the boundary layer.

For a better understanding of the invention and to show how it works and how it can be carried into effect, reference is directed to the enclosed drawing, which shows a midship section of a tanker according to the present invention.

The tanker vessel consists of a single hull with a bottom plating 10, lower side wall 12, upper side wall 14, and an upper deck 16.

The hull is arranged with two vertical and oil tight longitudinal bulkheads 18 and with a horizontal tween deck 22 in the side tank at about half-depth of the hull.

Furthermore, the hull has a number of vertical transverse bulkheads that are not shown, which together with the longitudinal bulkheads 18, bottom 10, sides 12 and 14, the upper deck 16 and the tween deck 22 forms a number of tank compartments i.e. lower side tank compartments 24, upper side tank compartments 26 and centre tank compartments 28.

The lower side tank compartments 24 are at the head connected to one or more oil riser trunks 30, which are accessible from the upper deck 16, and which, for example, have a horizontal area of 5–10 square metres and a total volume corresponding to about 1–3% of the volume of the associated tank. The oil riser trunk is also used for space for access to the tank.

The upper side wall 14 is inclined outboard so that its upper corner is about 2 metres outside of the lower side wall 12. A cofferdam 32 is arranged in the lower side wall 12. A liner 34 of reinforced, elastic plastic material is fitted on the cargo tank side of the cofferdam 32.

A pipe branch 36 with a non-return valve 38 connects the oil riser trunk 30 with an oil reception tank (not shown) or an upper side tank compartment, which is located at a distance from the tank of the riser trunk.

In collision, the other ship or object can first damage the upper outboard sloping side 14 and associated platings, frames and transverse webs. The upper side tank compartment 26, which is a ballast tank is water filled without oil spill.

The lower side wall 12 can also be damaged including the cofferdam 32 and the liner 34, but the latter is expected to reduce the water inflow into the lower side tank compartment 24.

The lower side tank compartment 24 is filled by water through the hole in the side, whereby the water flows to the bottom of tank 24 and the oil is pressed up against the horizontal deck 22 and up into the oil riser trunk 30. From the oil riser trunk, the oil escapes through the pipe connection 36 and the non-return valve 38 to the reception tank.

In collision and when water flows into the lower side tank compartment 24, the oil forms a bubble which floats in the water and is kept in place by the undamaged parts of the tank and by the inflowing water itself. The oil bubble is kept together by surface tension in the boundary layer between oil and water and by viscous forces in the oil, and as long as the water inflow into the tank is moderate, then the oil bubble remains intact while it is emptied through the pipe connection 36, whereby it does not flow out through the hole in the side against the inflowing water.

The arrangement of the invention can completely or partly be installed in existing tanker vessels to improve their collision protection. A tween deck is then fitted in an existing side tank and at the same time, a cofferdam is built in the side of the lower side tank. One or more riser trunks are fitted to connect the lower side tank with the upper deck. A liner is fitted on the tank side of the cofferdam.

It can be difficult to rearrange the upper side wall to be outboard sloping, but still half the ship's side is completely protected against collisions with smaller ships which have a limited draught and cannot reach the lower side tank.

It is also a fact that the flare of the bow of many ships only damages the upper side of the other ship.

I claim:

1. Tanker vessel, particularly for transport of oil or other liquids, which are lighter than water and present a danger to the environment, which comprises a hull with a bottom (10), two opposite side walls (12, 14), and upper deck (16), at least two mainly vertical longitudinal bulkheads (18) and a number of transverse bulkheads, which together form a number of centre tank compartments (28) and side tank compartments (24,26), wherein a mainly horizontal tween deck (22), located considerably below the vessel's loaded water line, divides at least the side tank compartments into upper and lower side tank compartments (26 resp. 24), the upper side tanks (26) being water ballast tanks while the lower side tanks (24) being cargo oil tanks, which at the head are connected to oil riser trunks (30), which via a pipe branch (36) with a non-return valve are connected to an oil reception tank.

2. Tanker vessel as claimed in claim 1 wherein the lower side tanks (24) are fitted with a cofferdam (32) in at least the upper part of their outer side wall (12).

3. Tanker vessel as claimed in claim 2 wherein a liner (34) of reinforced, elastic plastic material is fitted on the tank side of the cofferdam (32).

4. Tanker vessel as claimed in claim 1 wherein the volume of the riser trunks (30) is about 1–3% of the volume of the associated lower side tank (24).

5. Tanker vessel as claimed in claim 1 wherein the outer side wall (14) of the upper side tanks (26) are inclined outboard from the mainly vertical side wall (12) of the lower side tanks (24).

6. Tanker vessel as claimed in claim 2 wherein the volume of the riser trunks (30) is about 1–3% of the volume of the associated lower side tank (24).

7. Tanker vessel as claimed in claim 3 wherein the volume of the riser trunks (30) is about 1–3% of the volume of the associated lower side tank (24).

8. Tanker vessel as claimed in claim 2 wherein the outer side wall (14) of the upper side tanks (26) is inclined outboard from the mainly vertical side wall (12) of the lower side tanks (24).

9. Tanker vessel as claimed in claim 3 wherein the outer side wall (14) of the upper side tanks (26) is inclined outboard from the mainly vertical side wall (12) of the lower side tanks (24).

10. Tanker vessel as claimed in claim 4 wherein the outer side wall (14) of the upper side tanks (26) is inclined outboard from the mainly vertical side wall (12) of the lower side tanks (24).

11. Tanker vessel as claimed in claim 6 wherein the outer side wall (14) of the upper side tanks (26) is inclined outboard from the mainly vertical side wall (12) of the lower side tanks (24).

12. Tanker vessel as claimed in claim 7 wherein the outer side wall (14) of the upper side tanks (26) is inclined outboard from the mainly vertical side wall (12) of the lower side tanks (24).

13. Tanker vessel as claimed in claim 1 wherein said pipe branch is connected to said oil riser trunks at a lower region of said trunks.

* * * * *

UNITED STATES PATENT AND TRADEMARK OFFICE

CERTIFICATE OF CORRECTION

PATENT NO. : 5,335,615
DATED : August 9, 1994
INVENTOR(S) : Bengt A.S. Bjorkman

It is certified that error appears in the above-identified patent and that said Letters Patent is hereby corrected as shown below:

On the title page, item [76] inventors, should read--Bengt Anders Staffan Björkman--.

Signed and Sealed this

Twenty-eight Day of March, 1995

*Attest:*

Bruce Lehman

BRUCE LEHMAN

*Attesting Officer*

*Commissioner of Patents and Trademarks*